US011130125B2

(12) United States Patent
Kaigala et al.

(10) Patent No.: US 11,130,125 B2
(45) Date of Patent: Sep. 28, 2021

(54) PREVENTION AND BUBBLE REMOVAL FROM MICROFLUIDIC DEVICES

(71) Applicant: Bio-Rad Laboratories, Inc., Hercules, CA (US)

(72) Inventors: Govind Kaigala, Rueschlikon (CH); Robert Dean Lovchik, Schoenenberg (CH); Anna Fomitcheva Khartchenko, Zurich (CH); Iago Pereiro Pereiro, Zurich (CH); Lorenzo Franco Teodoro Petrini, Verscio (CH)

(73) Assignee: Bio-Rad Laboratories, Inc., Hercules, CA (US)

( * ) Notice: Subject to any disclaimer, the term of this patent is extended or adjusted under 35 U.S.C. 154(b) by 233 days.

(21) Appl. No.: 16/532,825

(22) Filed: Aug. 6, 2019

(65) Prior Publication Data

US 2021/0039092 A1 Feb. 11, 2021

(51) Int. Cl.
*B01L 3/00* (2006.01)

(52) U.S. Cl.
CPC ... *B01L 3/502707* (2013.01); *B01L 3/502715* (2013.01); *B01L 2200/0684* (2013.01); *B01L 2400/0487* (2013.01)

(58) Field of Classification Search
CPC ..... B01L 2200/0684; B01L 2400/0487; B01L 3/502707; B01L 3/502715; B01L 3/502723; B01L 2400/0442; B01L 2400/0406
See application file for complete search history.

(56) References Cited

U.S. PATENT DOCUMENTS

| | | | | |
|---|---|---|---|---|
| 5,890,745 | A | 4/1999 | Kovacs | |
| 9,625,454 | B2 | 4/2017 | Strey et al. | |
| 2002/0117517 | A1 | 8/2002 | Unger et al. | |
| 2004/0197043 | A1 | 10/2004 | Cyr et al. | |
| 2006/0060515 | A1* | 3/2006 | Benevides | G01N 30/6034 210/198.2 |
| 2013/0333761 | A1 | 12/2013 | Delamarche et al. | |
| 2015/0209783 | A1 | 7/2015 | Ingber et al. | |

(Continued)

FOREIGN PATENT DOCUMENTS

| | | | |
|---|---|---|---|
| DE | 102013207232 | A1 | 10/2014 |
| EP | 3162441 | A1 | 5/2017 |

(Continued)

OTHER PUBLICATIONS

International Search Report and Written Opinion dated Nov. 17, 2020 in International Patent Application No. PCT/US2020/045120. 11 pages.

(Continued)

*Primary Examiner* — Jennifer Wecker
(74) *Attorney, Agent, or Firm* — Kilpatrick Townsend & Stockton LLP

(57) ABSTRACT

A method for manufacturing a fluidic device is provided. The method comprises providing a capillary, providing a structure having a fluidic channel and an opening, reducing an outer diameter of a portion of the capillary to be smaller than the opening of the structure. Furthermore, the method comprises inserting, at least partly, the portion of the capillary through the opening of the structure into the fluidic channel and applying heat to the structure to expand the inserted portion of the capillary to fit the capillary to the structure.

19 Claims, 17 Drawing Sheets

(56) References Cited

U.S. PATENT DOCUMENTS

| | | | |
|---|---|---|---|
| 2017/0059590 | A1 | 3/2017 | McPeak et al. |
| 2017/0121663 | A1 | 5/2017 | Hinojosa et al. |
| 2018/0117588 | A1 | 5/2018 | Ingber et al. |
| 2018/0200677 | A1 | 7/2018 | Lee et al. |
| 2018/0318831 | A1 | 11/2018 | Kaigala et al. |

FOREIGN PATENT DOCUMENTS

| | | | |
|---|---|---|---|
| EP | 2593231 | B1 | 10/2018 |
| KR | 20090105249 | A | 10/2009 |
| WO | 2012007182 | A1 | 1/2012 |
| WO | 2015132686 | A1 | 9/2015 |

OTHER PUBLICATIONS

Lovchik et al., "Structures to Define Flow Confinement Shape and Confinement Stability With Uniform Aspiration", U.S. Appl. No. 16/532,766, filed Aug. 6, 2019.

Lovchik et al., "Structures on Microfluidic Devices to Control Sedimentation", U.S. Appl. No. 16/532,798, filed Aug. 6, 2019.

List of IBM Patents or Patent Applications Treated As Related, Dated Aug. 6. 2019, 2 pages.

Rousset et al., "Simulation-assisted design of microfluidic sample traps for optimal trapping and culture of non adherent single cells, tissues, and spheroids", Scientific Reports, Published Online: Mar. 21, 2017, DOI:10.1038/s41598-017-00229-1, 12 pages.

* cited by examiner

PREVENTION AND BUBBLE REMOVAL FROM MICROFLUIDIC DEVICES

BACKGROUND

The present disclosure relates generally to a method for manufacturing a fluidic device, and more specifically, to a method for prevention of bubbles and their removal from microfluidic devices and microfluidic interconnects. The present disclosure relates further to a microfluidic device.

The formation of bubbles in microfluidic devices is a common occurrence. Bubbles within micro-sized channels can cause numerous problems. For example, they can alter the flow of the liquid, block channels, destroy fragile surfaces, and interfere with cells and other bio analytes on surfaces or in suspensions.

In order to perform robust assays or bio-assays, it is desirable to have a microfluidic system with a reduced number of unwanted bubbles.

Bubble appearance is more frequent, for example, in rough regions and at interfaces, which serve as nucleation points of bubble. Bubble appearance is also more frequent at elevated temperatures, because gas solubility is reduced in heated liquids. The gas that cannot be solubilized will emerge in form of a bubble and tend to emerge from nucleation points. Bubble appearance is also more frequent when there is deficient sealing. Air can accidentally penetrate in the microfluidic system, either when using a permeable material or with deficient sealing. Bubble appearance is also more frequent at high flow rates. If higher fluid flow rates are used, a bubble will appear sooner than if lower flow rates are implemented. This is due to the Venturi effect where a higher fluidic velocity results in a lower pressure. Bubble appearance can occur in both closed microfluidic systems, as well as open-space microfluidic platforms.

Microfluidic systems such as a Microfluidic Probe (MFP) may be affected by bubbles, especially at the interface between the microchannels of the MFP Head and the tubing system that connect it to the peripherals.

When the bubbles are sufficiently large, they may be swept by the flow and brought to the reaction area of, for example, a microfluidic probe. The bubbles are typically unwanted at the reaction area. They may falsify reaction results and may render experiments useless.

Hence, there is a need to reduce bubbles in microfluidic devices.

SUMMARY

In an embodiment, a method for manufacturing a fluidic device is provided. The method includes providing a capillary, and providing a structure having a fluidic channel and an opening. The method also includes reducing an outer diameter of a portion of the capillary to be smaller than the opening of the structure. The method includes inserting, at least partly, the portion of the capillary through the opening of the structure into the fluidic channel. The method also includes applying heat to the structure to expand the outer diameter of the inserted portion of the capillary to fit the capillary to the structure.

In an embodiment, a fluidic device comprises a capillary, and a structure having a fluidic channel and an opening. In this embodiment, a first portion of the capillary is inserted into at least a portion of the structure through the opening, and a second portion of the capillary extends outward from the structure. An outer diameter of the second portion of the capillary is greater than a diameter of the opening, and an outer diameter of the first portion of the capillary is the same as the diameter of the opening.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Embodiments are described, by way of example only, and with reference to the following drawings.

DETAILED DESCRIPTION

Figure 1A:
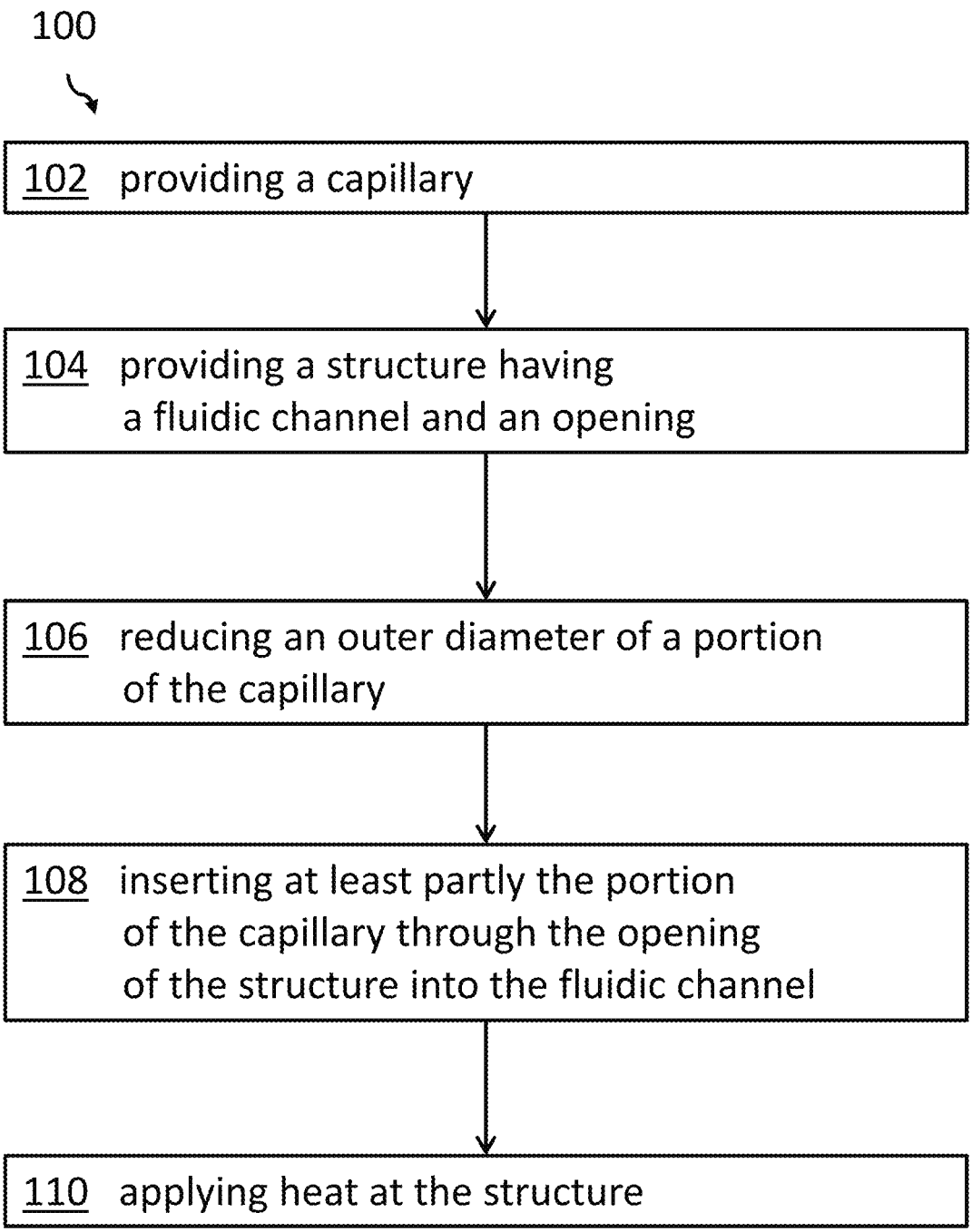
FIG. 1*a* shows a block diagram of an embodiment of a method for manufacturing a fluidic device.

In the context of this description, the following conventions, terms and/or expressions may be used:

The term 'capillary' may denote a small tube in which capillary forces or capillary action may be active. Capillary action (sometimes also denoted as capillarity, capillary motion, capillary effect, or wicking) may be understood as the ability of a liquid to flow in narrow spaces without the assistance of, or even in opposition to, external forces like gravity. The capillary may be a plastic or polymeric capillary and/or may also be denoted as capillary tubing.

The term 'structure' may denote a microfluidic device or microfluidic probe or a portion thereof. Examples of applications, where the microfluidic probe may be used, may comprise patterning protein arrays on flat surfaces, mammalian cell stimulation and manipulations, localized perfusion of tissue slices, and generating floating concentration gradients.

The term 'fluidic channel' may denote a longitudinal hollow structure, for example a channel, for transporting liquids and/or gas. In particular, the fluidic channels may be liquid channels for liquids.

The term 'opening' may denote a hole or space that fluids may pass through.

The term 'diameter,' in the mathematical sense, may denote a line segment passing through the center of a circle with its endpoints on the circle. The term 'outer diameter' may define the circle around the capillary.

The term 'portion of the capillary' may denote a section of the capillary such that not the whole capillary is reduced in its diameter.

The term 'microfluidic channel' may denote a channel for fluids in a μm diameter range, e.g., 50 μm up to 1 mm.

The term 'first end' may denote a beginning or an end of the fluidic channel of the structure. For example, the first end may define a point where the capillary is put through. In contrast, the term 'second end' may denote the respective other end of the fluidic channel of the structure with respect to the first end.

The term 'adapter' may denote a cutting help for defining an edge, the cutting tool needs to cut at. The cutting help may be used to cut off a portion of a capillary.

The term 'step-like structure' may denote a structure defining a fluidic channel which narrows stepwise in diameter.

The opening may have a square shape, round shape, rectangular shape, hexagonal shape, or any other suitable shape, and the applied heat may be in a range of 60° C. up to 200° C., for example 80° C. up to 130° C. In particular, the heat may be higher than 60° C. (or alternatively, >70° C. or >80° C. or >90° C. or >100° C. or >110° C.). Additionally, the heat may be lower than 200° C. (or <190° C. or <180° C. or <170° C. or <160° C. or <150° C. or <140° C. or <130° C. or <120° C. or <110° C. or <100° C.).

Furthermore, the fitting of the capillary to the structure may be in the form of sealing the capillary together with the structure, and the capillary may be inserted through the opening of the structure into the fluidic channel and through the fluidic channel.

It may also be useful that the inner and outer diameters of the capillary and the other capillary may be the same.

Additionally, the fluidic cannel may have an indent, for example a cavity which may broaden the fluidic channel.

The outer diameter of the capillary (before reducing its diameter) may be in the range of 50 μm up to 5 mm, in particular, between 500 μm up to 5 mm Similar ranges may be used for the outer diameter of the opening of the structure which may be in the range of 50 μm up to 5 mm, in particular, between 50 μm up to 500 μm.

The portion of the at least one other capillary may be inserted in parallel to the insertion of the capillary into the structure, in particular, simultaneously or aligned similarly.

The methods for manufacturing a fluidic device according to the embodiments may achieve one or more of the following technical effects.

Bubbles appearing within microfluidic devices may be reduced or avoided completely. In traditional (or standard) microfluidic devices, bubbles may appear in other sealing methods (glue, clay, resin, Polydimethylsiloxane, PDMS or screwed fittings). These disadvantages of the existing sealing methods may be reduced or avoided completely.

Thus, continuity at the capillary-device interface (no leakage or bubble source) may be achieved. Hence, an impermeable nucleation point free microfluidic channel is provided. The sealing avoids air introduced in the connected flow path since no air-liquid interface is available.

A smooth fluid path that is sealed from air, and that does not contain nucleation points (rough surfaces lead to nucleation points) on which air bubbles may be generated, may allow operating a microfluidic device, such as the microfluidic probe head, without having any trouble or danger that experimental results may be negatively influenced.

In respect to geometric forms of the capillaries, capillaries with complex design shapes may be provided. The present embodiments do not introduce any design restrictions when compared to existing geometrical forms, but they may the advantage of a complete reduction of bubble nucleation structures. In another embodiment, the shape of the capillary remains constant after the procedures.

Also the resulting devices according the present embodiments may offer multiple advantages and technical effects: the device may be used with different flow rates (0.1 μl/min to 1000 μl/min) which represent a wide application area; the device may be used at different temperatures (20° C. to 90° C.) which represent a range in which typically experiments of material from living organisms are performed.

The device may also advantageously be used at the presence of surfactants (surface active agents), different buffers (sodium chloride (NaCl), phosphate buffered saline (PBS), low ionic strength (LIS) buffer) and complex biological samples (Plasma, Red Blood Cells, bacteria, tissue lysates, nuclei acids, proteins). Also here, the proposed method does not imply any limitations when compared to traditional approaches.

Structures containing channels (e.g. microfluidic probe, MFP, head) connected to capillaries using the method proposed may be adapted to work at even more extreme conditions as already mentioned, for instance, at higher temperature (under traditional circumstances, higher temperatures may have a higher risk of a presence of bubbles), using different flow rates or liquids with different surface tension properties (e.g., surfactants, alcohols).

The addition of an indent in a fluidic channel of the surrounding structure can improve the locking of the expanded capillary. The sealing resistance to tensile forces exerted on the capillary may thus increase.

In the following, additional embodiments are described.

According to an embodiment of the proposed method, the fluidic channel extends from the opening of the structure into the structure.

According to an embodiment of the proposed method, the step of reducing the outer diameter of the portion of the capillary comprises stretching at least the portion of the capillary to reduce the outer diameter of the portion of the capillary.

According to an embodiment of the proposed method, the fluidic channel is a microfluidic channel.

According to an additional embodiment of the proposed method, the outer diameter of the portion of the capillary may be equal or larger than the opening of the structure before the step of stretching is performed.

According to an embodiment of the proposed method, the structure is another capillary. In consequence, an inner diameter of the other capillary is defined by a diameter of the fluidic channel. Thus, the capillary can be put into the other capillary.

According to an embodiment of the proposed method, the structure may be a microfluidic device; or alternatively a microfluidic probe or microfluidic chip.

According to an embodiment of the proposed method, a material of the microfluidic device is at least one of the following: silicon, glass, poly methyl methacrylate, PMMA, polydimethylsiloxane, PDMS, aluminum, stainless steel, ceramics and other polymers. Hence, the here embodiments allow for a wide variety of different materials, all of which may be used for microfluidic devices as understood by one skilled in the art.

According to an embodiment of the proposed method, a material of the capillary is at least one polymer of the following list: ethylene tetrafluoroethylene, ETFE, ethylene chlorotrifluoroethylene (ECTFE), Fluorinated ethylene propylene(FEP), polyether ether ketone (PEEK), polytetrafluoroethylene (PTFE), perfluoro alkoxy alkane (PFA) polyvinylidene difluoride (PVDF), and tetrahydrocannabivarin (THV). Also here, a wide variety of different materials may be used. The product designer may not face significant limitations if choosing an appropriate material for the purpose of the device.

According to an embodiment of the proposed method, the fluidic channel includes an indent for locking the capillary with the structure.

According to an embodiment of the proposed method, the outer diameter of the capillary is in the range of about 50 μm up to 5 mm. According to an embodiment of the proposed method, the opening of the structure has a diameter in the range of about 50 μm up to 5 mm.

According to an embodiment of the proposed method, the structure comprises another opening. The opening of the structure is a first end of the fluidic channel and the other opening of the structure is a second end of the microfluidic channel. The portion of the capillary is least be partly inserted and put through the fluidic channel to extend from the first end to the second end.

According to an embodiment, the method further comprises providing an adapter for surrounding a section of the capillary which extends over the second end, providing a cutting tool, and cutting, by the cutting tool, the capillary along an edge specified by the adapter. Furthermore, the method comprises, after cutting the capillary, performing the step of applying heat to or at the structure.

According to an embodiment of the proposed method, the fluidic channel has a step-like structure. Each step reduces a diameter of the fluidic channel such that the diameter of the fluidic channel gets smaller and smaller from the opening in a direction into the structure (e.g., in a direction of the fluid flow).

According to an embodiment, the method further comprises, after applying heat to the structure, pulling the capillary out of the structure to obtain a capillary having a varying diameter.

According to an embodiment, the method further comprises providing a sensing device, and inserting the sensing device into the fluidic channel, before applying heat to the structure, to fit the sensing device together with the capillary to the structure. The sensing device may denote a fluid flow sensor, a temperature sensor or any sensor instrumental to measure a fluid parameter, such as a fluid flow or pH value.

According to an embodiment, the method further comprises providing at least one other capillary, reducing an outer diameter of a portion of the at least one other capillary, and inserting, at least partly, the portion of the at least one other capillary in parallel to the insertion of the capillary into the structure.

According to an embodiment, the device is a microfluidic device.

In the following, a detailed description of the figures will be given. All instructions in the figures are schematic. First, a block diagram of an embodiment of a method for manufacturing a fluidic device is given. Afterwards, further embodiments, as well as embodiments of the device, will be described.

FIG. 1*a* shows a block diagram of an embodiment of the method 100 for manufacturing the fluidic device. The method comprises providing, 102, a capillary, providing, 104, a structure having a fluidic channel and an opening, reducing, 106, an outer diameter of a portion of the capillary to be smaller than the opening of the structure, inserting, 108, at least partly, the portion of the capillary through the opening of the structure into the fluidic channel, and applying, 110, heat to the structure for expanding the inserted portion of the capillary to fit the capillary to the structure.

Figure 1B:
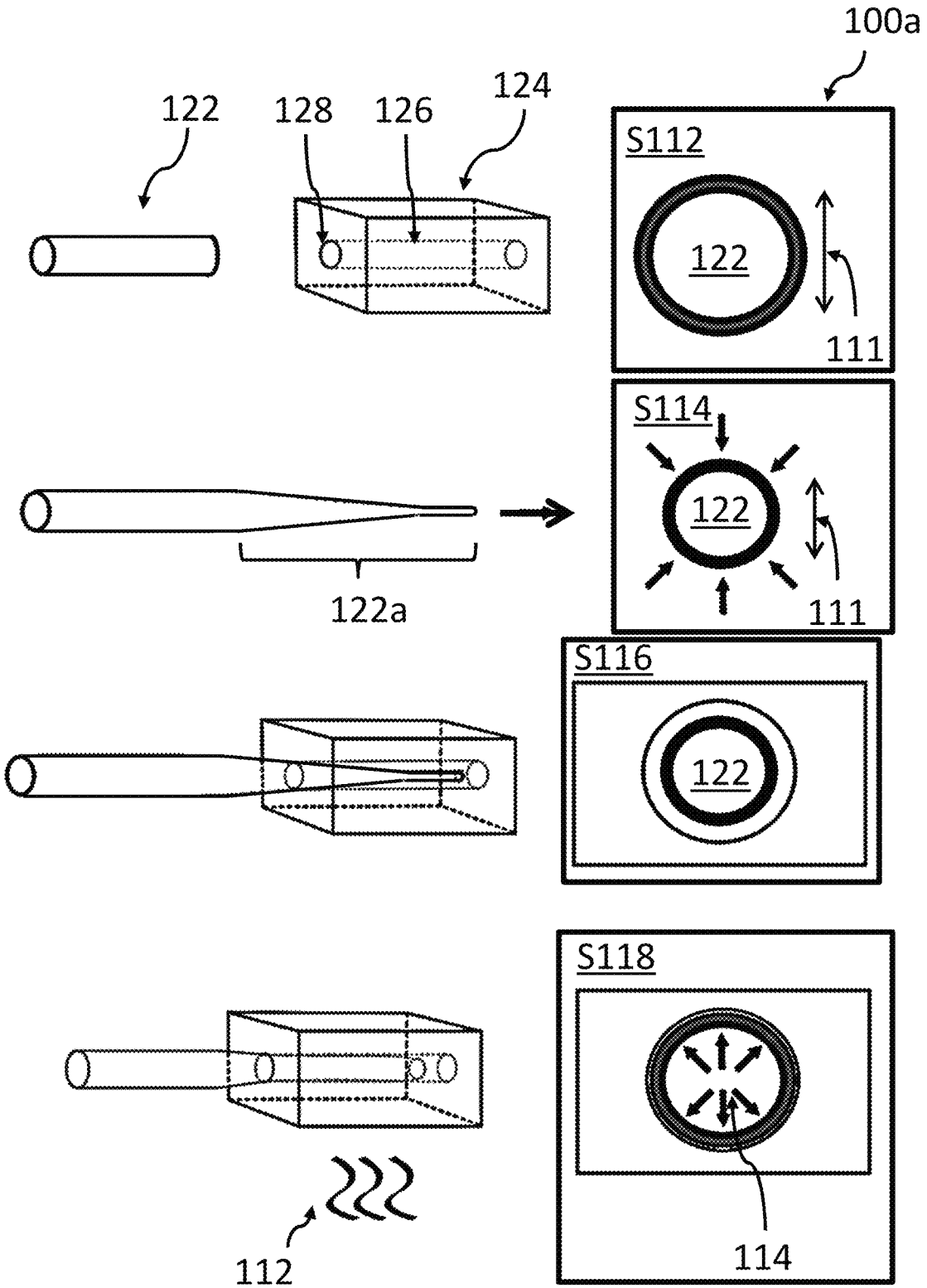
FIG. 1*b* shows a schematic illustration of an embodiment of a method for manufacturing a fluidic device that minimizes microfluidic interconnects.

FIG. 1*b* shows a graphical representation 100*a* of the method 100 for manufacturing a fluidic device. The device may be a microfluidic device. The method 100 comprises providing, S112, a capillary 122. The method further comprises providing, S114 a structure 124. This is shown as a simple block; however, the structure 124 may have any suitable form. The structure 124 has a fluidic channel 126 and a related opening 128 (at least one). The fluidic channel 126 in FIG. 1*a* is shown as a straight tunnel through the structure. However, the tunnel may also have a bend form inside the structure 124 or may lead around corners inside the structure 124. The opening 128, as well as the fluidic channel 126 may have a square shape, a round shape, a rectangular shape or a hexagonal shape. The same may apply to the capillary 122. However, in the illustrated example, the capillary 122 is shown to be tubular. However, the embodiments are not be restricted to this shape. On the right-hand side of FIG. 1*b* in step S112, a schematic illustration of the diameter 111 of the capillary 122 is shown. The diameter 111 may be larger than the diameter of the opening of the structure 124 (after step S112) and before step S114.

In step S114, the method 100 comprises reducing an outer diameter of a portion 122*a* of the capillary 122 to be smaller than the opening of the structure 124. Consequently, the beforehand larger diameter of the capillary 122 has been reduced in step S114, and can therefore be inserted into the opening 128 of the structure 124. Thus, in step S116, the method 100 comprises inserting, at least partly, the portion 122*a* of the capillary 122 through the opening 128 of the structure 124 into the fluidic channel 126. Therefore, fluid may then flow through the capillary 122 into the fluidic channel 126 of the structure. Further, in order to reduce bubble creation, the method 100 comprises in step S118 applying heat, in particular in a range of 60° C. up to 200° C., on the structure 124 for expanding the inserted portion 122*a* of the capillary 122 to fit the capillary 122 to the structure 124. In consequence, the outer circumference of the portion 122*a* of the capillary 122 may be lined with the fluidic channel 126 of the structure 124. The expansion of the capillary 122 is performed by applying heat 112 (symbolically shown as (heat-)waves) to it. Since the structure 124 is heated, the heat 112 is transferred to the capillary 122 as well which leads to the expansion (illustrated through the arrows 114). Thus, fluid may then be introduced on either an end of the capillary 122 or at an end of the fluidic channel 126 to have a fluid flow from the capillary 122 to the fluidic channel 126 of the structure 124 or, reversely, from the fluidic channel 126 of the structure 124 through the capillary.

The capillary 122 may be fitted to the structure 124 by sealing the capillary 122 together with the structure 124. Bubble creation may so be prevented at impurities on an inner surface of the fluidic channel 126 of the structure 124, such as unevenness, bumps or roughness.

The deformation of the capillary 122, for example polymer capillary, by tension and the subsequent partial recovery of the original structure mediated by heating allows the creation of a connection with a surrounding structure 124 whose thermal expansion is negligible compared to the deformation of the capillary 122.

For example, the structure may be in the form of a capillary. Locking of two capillaries (instead of a capillary and a solid structure) may also allow creating a flow path. The capillaries may be composed of different polymer materials (e.g., ETFE, ECTFE, FEP, PEEK, PTFE, PFA, PVDF, THV). The two capillaries can be locked and sealed. According to FIG. 1*b* and step S114, an end of one of the capillaries is stretched to have a diameter slightly smaller than the other one of the capillaries. In an embodiment, the outer diameter of one of the two capillaries is smaller than an inner diameter of the other one of the two capillaries. Then, the capillary with the smaller sized diameter is inserted in the other (outer) capillary, see step S116. Heat is applied to the two respective capillaries—see step S118—for an expanding of the stretched, inner capillary. The two capillaries will thus be locked and sealed. In addition, the external capillary can also be stretched outwardly and heated to a smaller diameter, or be a shrinking tube (both options combined may lead to a stronger locking).

Outer capillary diameters may be in the μm-mm scale; for example ⅛ in, 1/16 in, 1/32 in (i.e., about 0.3 mm to 3 mm), or any other suitable diameters.

In case of locking of a capillary 122 (different materials, see above) inside a surrounding structure 124 (e.g., chip that may be composed by silicon, glass, PMMA, PDMS, metal or a hybrid material thereof), the proposed method for locking and sealing avoids the presence of an air-liquid interface in the connection thus preventing air from entering the system. In view of the method described with respect to FIG. 1*b*, in step S114, the method comprises stretching of one extremity of the capillary 122 to have a diameter slightly smaller than the opening in the solid structure 124. Further, the method comprises in step S116 the introduction of the stretched capillary inside the solid structure 124 opening 128. Furthermore, in step S118, the method comprises a heat 112 application for expansion of the stretched capillary 122 (in particular the stretched portion) inside the surrounding structure 124 opening 128.

More details and aspects are mentioned in connection with the embodiments described above or below. The embodiments shown in FIG. 1*a* and FIG. 1*b* may comprise one or more optional additional features corresponding to one or more aspects mentioned in connection with the proposed concept or one or more embodiments described below (e.g., any of the FIGS. 2-16).

Figure 2:
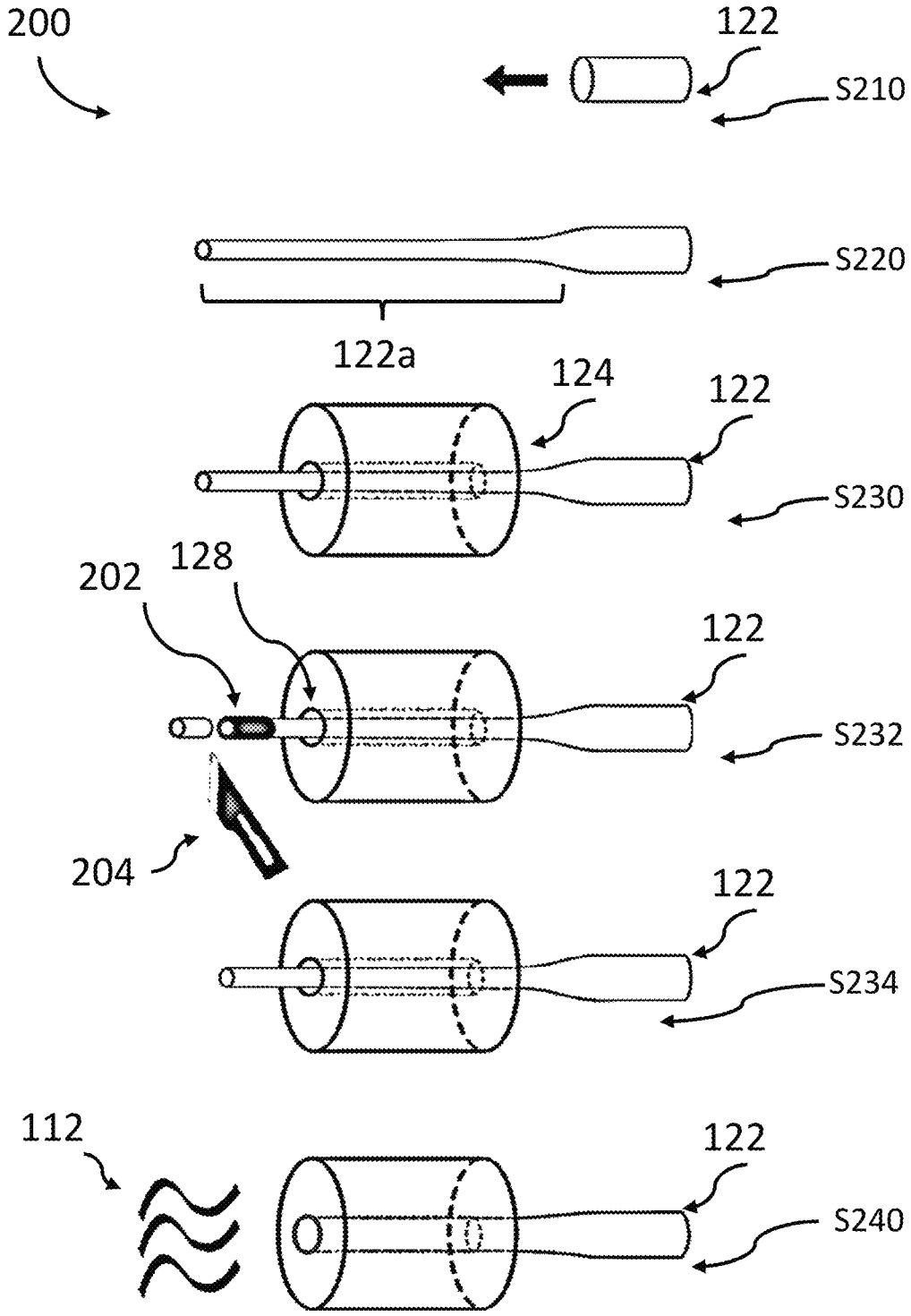
FIG. 2 shows a schematic illustration of an embodiment of a method for manufacturing a fluidic device with an adapter and a cutting tool.

Not all of the reference numerals in FIG. 1*b* have been repeated for identical parts in the various steps of FIG. 2.

FIG. 2 shows a schematic illustration 200 of an embodiment of a method 100 (compare FIG. 1*a*) for manufacturing a fluidic device with an adapter 202 and cutting tool 204. In step S210, the capillary is provided. In step S220, the capillary 122 is lengthened in size by stretching it. Thereby, inner and outer diameters of the capillary 122 are reduced. In step S230, the stretched part 122*a* of the capillary 122 is inserted and pushed through the structure 124 (here shown as round structure 124), in particular, the fluidic channel 126 of the structure 124. In step S232, an adapter 202 and a cutting tool 204 is provided and at a certain point defined by the adapter 202, the capillary 122 is cut. This may also be defined as adjustment of capillary length. The cut of the capillary 122 may be clean and parallel to the opening of the structure 124, for example, the microchannel aperture (or opening). The cutting tool 204 may be a scalpel using a larger capillary as the adapter 202, also called "holder". After cutting, the adapter 202 is removed in step S234. Then, in step S240, heat 112 is applied to seal the capillary 122 in the fluidic channel 126. The certain point may be set such that the end result has the capillary 122 and the fluidic channel 126 in line. Thus, one end of the capillary 122 and the opening 128 may be in a plane, as shown at the edge of the opening of the structure 128 on the left, in step S240. In consequence, bubbles up to an aperture of the structure may be avoided. To avoid any accidental removal of the capillary 122, an additional sealing can be applied between the structure 124 and the capillary 122 (for example glue or clay).

The removal of nucleation points due to a roughness of a surface of the fluidic channel 126 of the structure 124 may be avoided by cutting the capillary 122 with the sharp cutting tool 204 (e.g., scalpel) using the adaptor 202 (e.g., a larger diameter surrounding structure). The cut may have to be as clean as possible, e.g., using the sharp scalpel. An adapter structure 202 which is surrounding the capillary 122 may be used to perform a clean cut. Thus, a smooth surface on the corresponding capillary 122 section may be provided after the cut.

More details and aspects are mentioned in connection with the embodiments described above or below. The embodiment shown in FIG. 2 comprises one or more optional additional features corresponding to one or more aspects mentioned in connection with the proposed concept, or one or more embodiments described above (e.g., FIG. 1*a*) or below (e.g. FIGS. 3-16).

Figure 3:
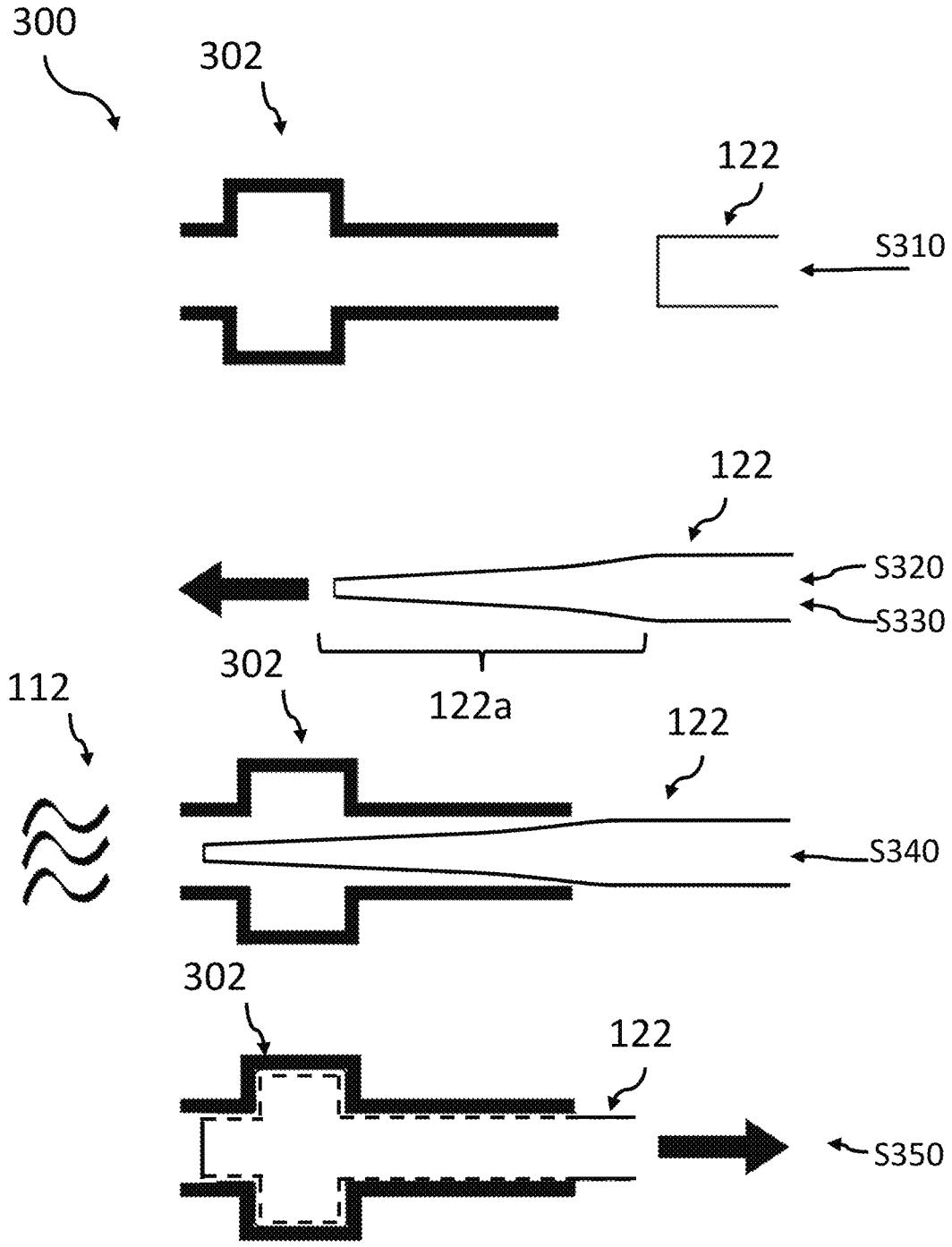
FIG. 3 shows a schematic illustration of an embodiment of a method for manufacturing a fluidic device with an indent in the fluidic channel of the structure.

FIG. 3 shows a schematic illustration 300 of an embodiment of a method for manufacturing a fluidic device with an indent 302 in the fluidic channel 126 of the structure 124. The method comprises providing an indented structure 302 and a capillary 122 in step S310. In step S320 and S330, the capillary 122 is inserted into the indented structure 302. In step S340, heat 112 is applied which leads to an expansion of the portion 122*a* of the capillary 122 inside the indent(s) 302 of the structure 124. In consequence, when trying to pull the capillary 122 out of the structure 124 in step S350, the capillary 122 will be stuck in the structure 124 due to the indents 302.

Figure 4:
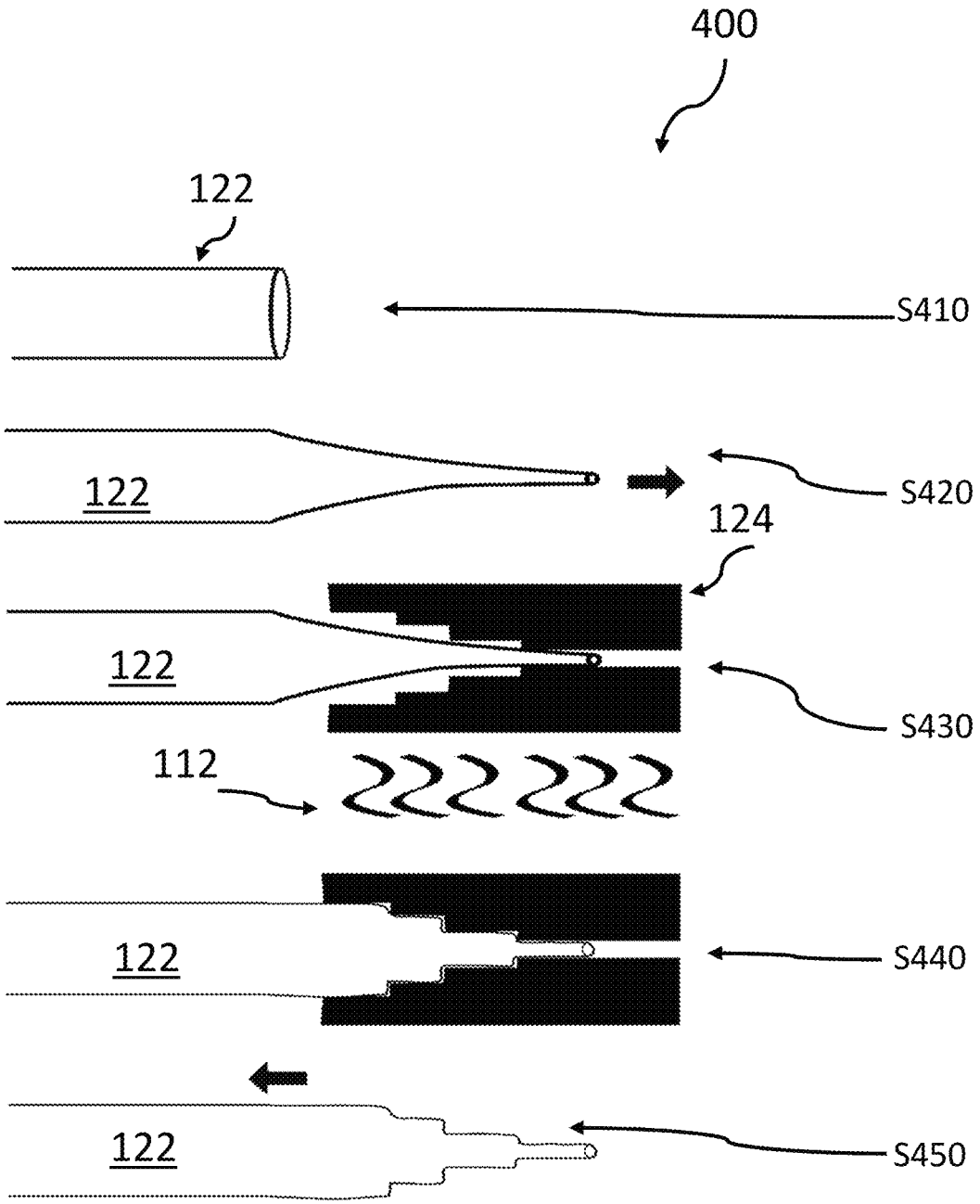
FIG. 4 shows a schematic illustration of an embodiment of a method for manufacturing a fluidic device with a step-like structure.

FIG. 4 shows a schematic illustration 400 of an embodiment of a method for manufacturing a fluidic device with a step-like structure. In step S410, the capillary 122 is provided. In steps S420, the capillary 122 is lengthened in size by stretching. Thereby, inner and outer diameters of the capillary 122 are reduced. In step S430, the capillary 112 is inserted into the step-like structured structure 124 and in step S440 heated. The structure 302 is formed, such that, by inserting, the steps narrow the diameter of the fluidic channel of the structure 124. This forms a step-like structured capillary 122. In step S450, the capillary 122 is then removed from the structure 124 by pulling it out. Therefore, a reformed capillary 122 is received having a step-like structure. The steps of the capillary 122 have a shape that corresponds to the shape of the steps of a related structure 124.

In particular, the stretched polymer capillary 122 may be shaped to a given geometry, after inserting the capillary 122 into a forming structure 124, by indirect heating of the capillary 122 in step S440 inside the forming structure 124 with a given geometry that serves as a mold, and then extracted by applying a force in step S450.

Figure 5:
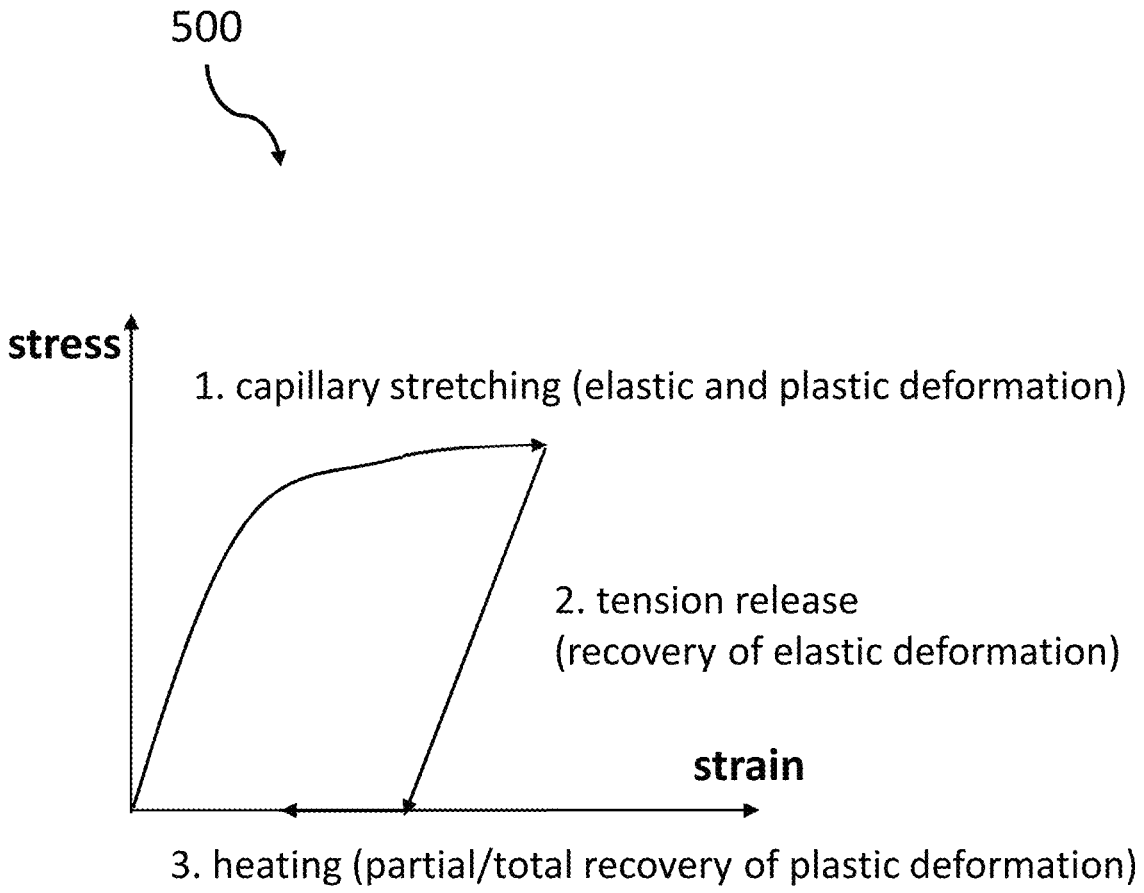
FIG. 5 shows a schematic illustration of capillary stress over capillary strain.

FIG. 5 shows a diagram 500 of capillary stress over strain. By stretching the capillary, the capillary is exposed to stress and strain. The corresponding curve is shown in FIG. 5. When stretching the capillary (in step 1 in FIG. 5), the capillary is exposed to higher stress and higher strain. When finishing with stretching (tension release), there is less stress on the capillary. The strain is then reduced by heating the capillary.

The change in diameter ΔD of a cylinder of length L after a deformation ΔL at the end of step 2 in FIG. 5 is given by:

$$\Delta D = -\nu D \frac{\Delta L}{L}$$

wherein ν is the plastic Poisson ratio (material-specific).

As illustrated in step 3 in FIG. 5, extended polymer chains tend to relax (viscoelasticity) with thermal energy. For T>Tg (glass transition temperature), the recovery of the strain is accelerated and can be total.

This partial recovery leads to an increase in the diameter of the capillary (expansion), translating into a locking mechanism within a surrounding structure.

In certain embodiments, the surrounding structure is composed of material with a melting temperature that is higher than the Tg of the polymer capillary (thermal expansion is negligible since it is reversible).

Figure 6:
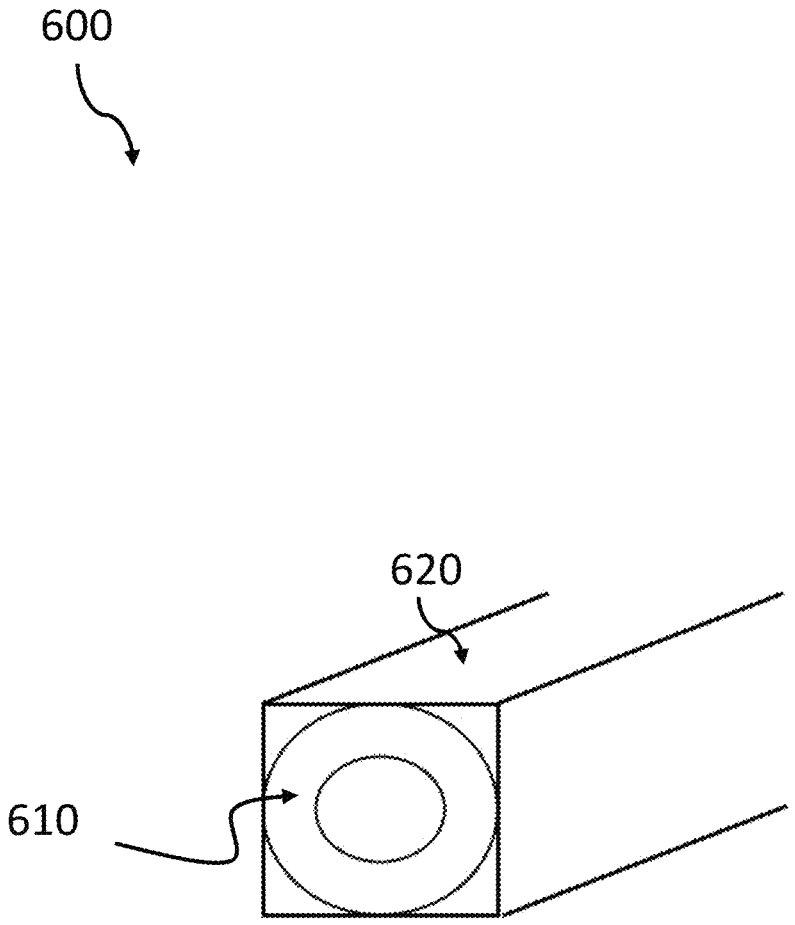
FIG. 6 shows a schematic illustration of an embodiment of a device with a structure having a fluidic channel with a square shape.

FIG. 6 shows a schematic illustration 600 of an embodiment of the proposed device with a structure having a fluidic channel 620 with a square shape. In other embodiment, the shape of the fluidic channel (not shown) may have a different profile or cross-section. In this embodiment, the device has a structure 620 and a capillary 610. The device is manufactured by a method described herein. Therefore, circular sections in microfluidic devices from normal squared sections may be provided due to the shape of the capillary 610.

Figure 7:
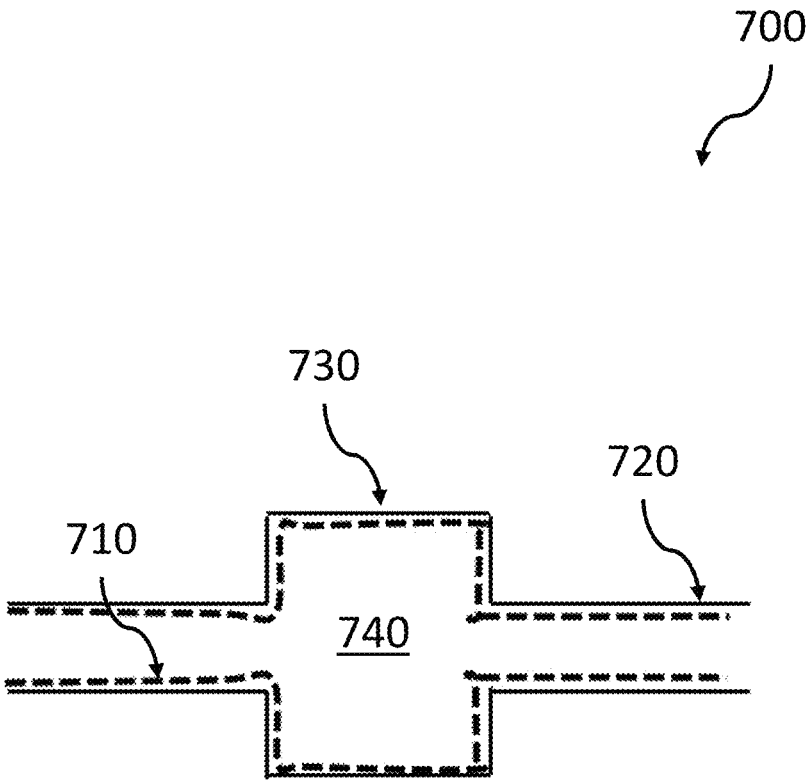
FIG. 7 shows a schematic illustration of an embodiment of a device with a structure having an indent.

FIG. 7 shows a schematic illustration of an embodiment of the proposed device 700 with a structure 720 having an indent 730. In this embodiment, the indent 730 is filled in consequence of the applied heat to the capillary 710. Further to that, the indent 730 provides a secure connection of the capillary 710 and the structure 720. Therefore, larger chambers 740 inside a microfluidic path are coated by the capillary 710.

Figure 8:
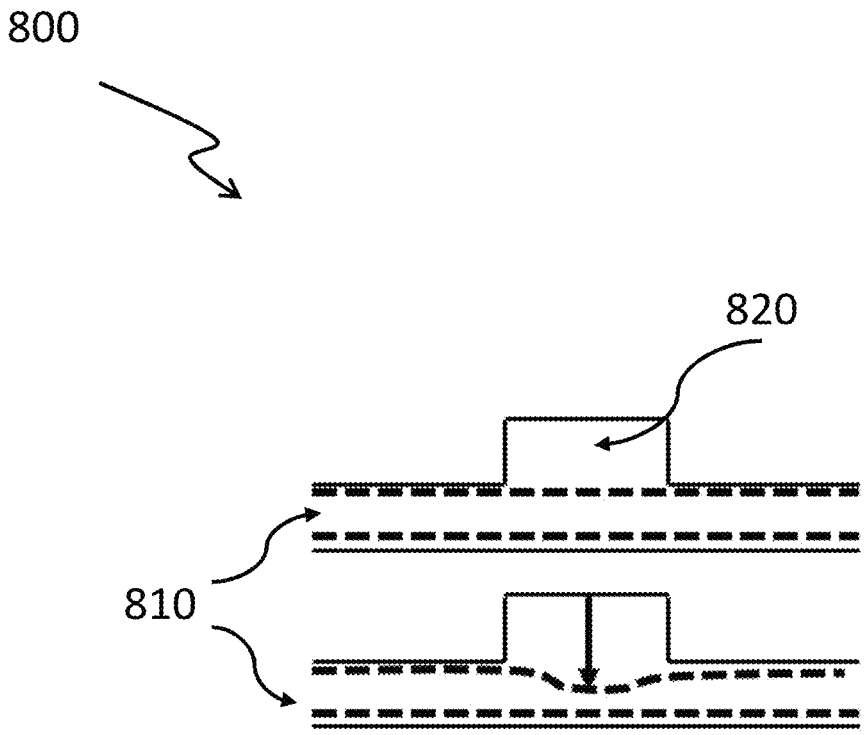
FIG. 8 shows a schematic illustration of an embodiment of a device with a valve.

FIG. 8 shows a schematic illustration of an embodiment of the device 800 with a valve 820 (not shown in detail). The valve 820 is provided as an indent of the structure. An inserted capillary 810 may then be prone to pressure from outside at the valve 820. As such, pressure may be increased by mechanical compression to the capillary 810.

Figure 9:
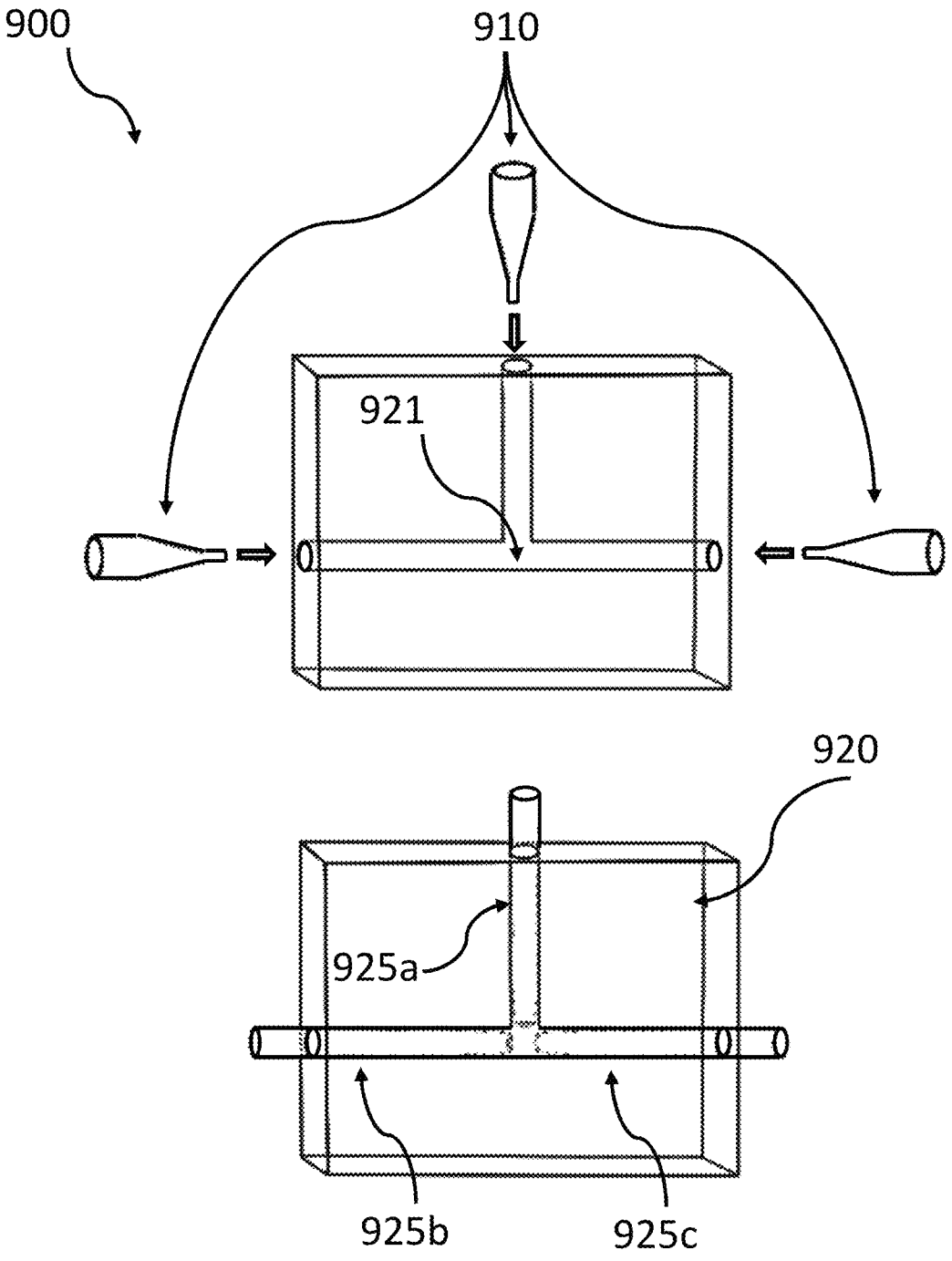
FIG. 9 shows a schematic illustration of an embodiment of a device with a T-junction.

FIG. 9 shows a schematic illustration of an embodiment of the device 900 with a T-junction 921. The T-junction 921 includes three fluidic channels 925*a*, 925*b*, 925*c* inside the structure 920. By inserting three capillaries 910 into the respective openings of the fluidic channels 925*a*, 925*b*, 925*c* of the structure 920 and applying heat to it, a device is manufactured. Thus, a microfluidic chip 900 with fluidic channels 925*a*, 925*b*, 925*c* coated with expanded capillaries 910 up to junction level are provided.

Figure 10:
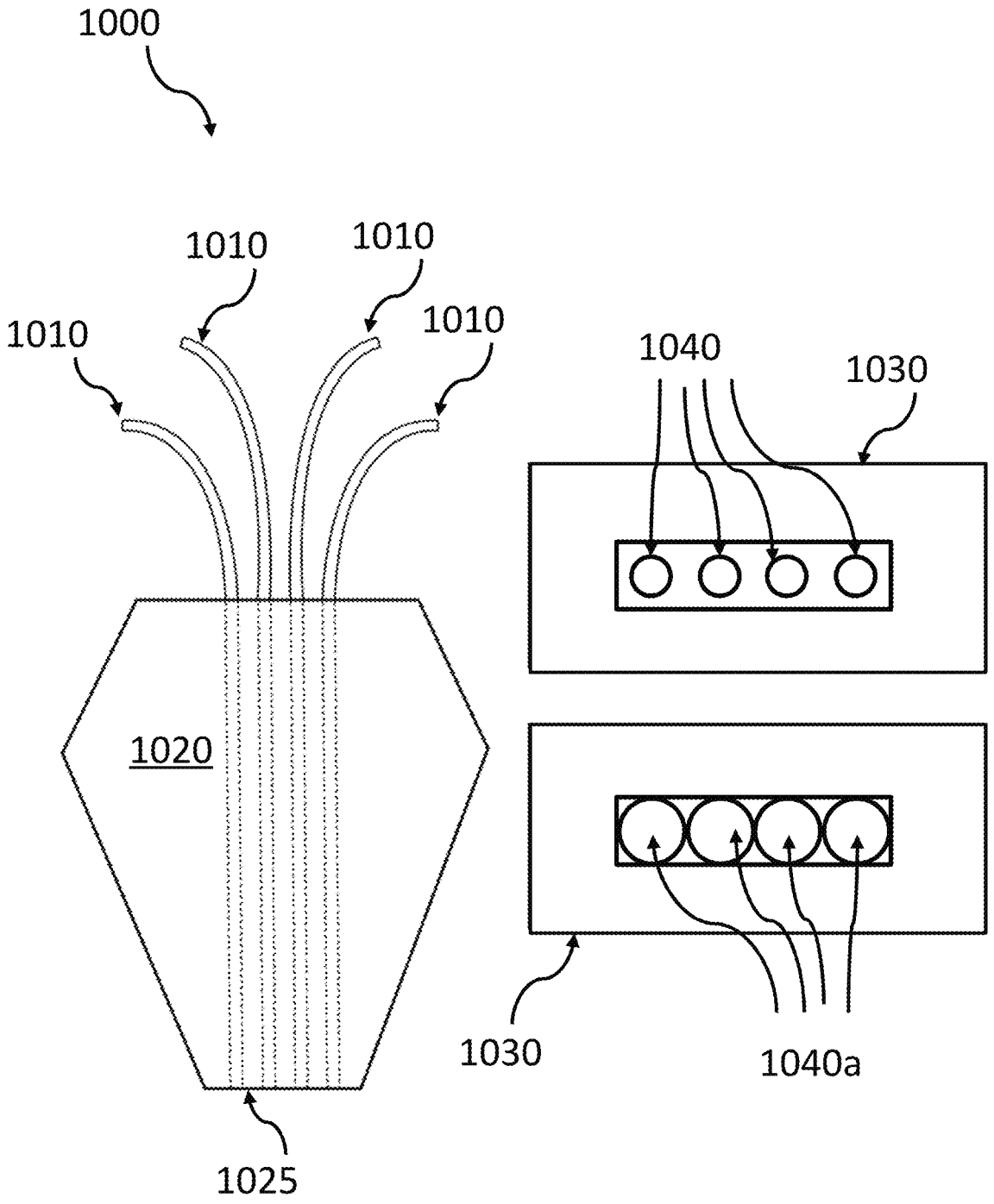
FIG. 10 shows a schematic illustration of an embodiment of a device with multiple capillaries.

FIG. 10 shows a schematic illustration of an embodiment of the device 1000 with multiple capillaries 1010. The capillaries 1010 may be put into an opening of the structure 1020 next to each other. Thus, by applying heat to the structure 1020, the capillaries 1010 are fixed in the structure 1020 in parallel to each other.

In an embodiment, in a view from the direction of the arrow 1025, the microfluidic device 1000 looks like a rectangle 1030 with four tube (capillary) openings 1040 (before the step of applying heat). After heat is applied, the capillaries 1010 on the left hand side of the figure are shown in a cross section on the right hand side of the figure with the enlarged openings 1040*a*, filling the channel more or less completely.

Figure 11:
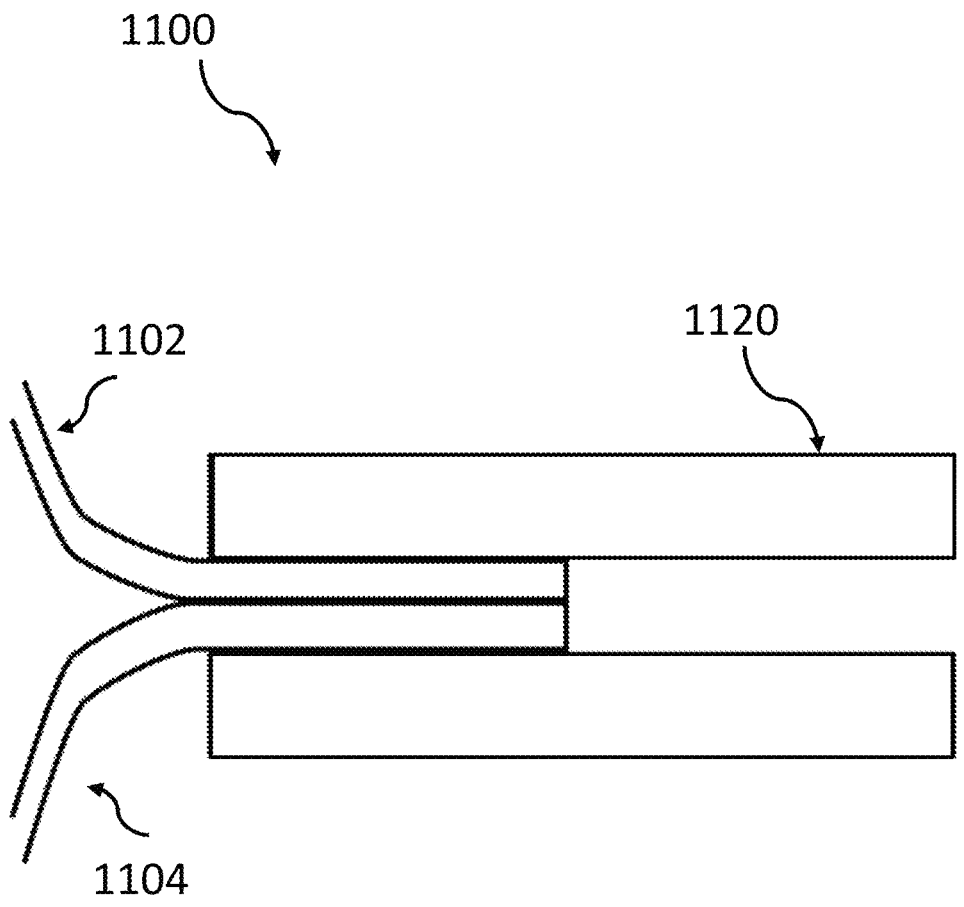
FIG. 11 shows a schematic illustration of an embodiment of a device with two parallel capillaries.

FIG. 11 shows a schematic illustration of an embodiment of a device 1100 with two parallel capillaries 1102, 1104. The two capillaries 1102, 1104 are provided in parallel. The sections of the capillaries 1102, 1104 inside the structure 1120 have a same length. Thus, an interface being at a same distance inside the structure 1120 is provided. Thus, expanded parallel cylinders for parallel laminar flows are provided.

Figure 12:
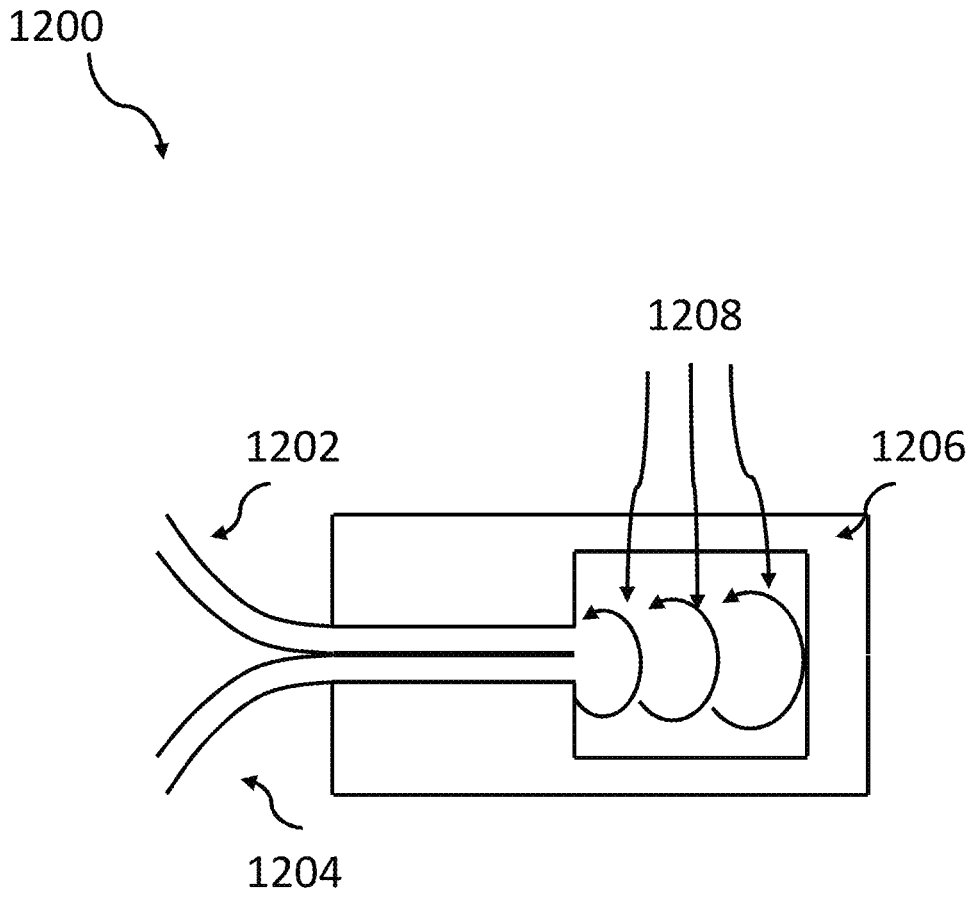
FIG. 12 shows a schematic illustration of an embodiment of a device with two parallel capillaries for recirculation.

FIG. 12 shows a schematic illustration of an embodiment of the device 1200 with two parallel capillaries 1202, 1204 inside the structure 1206 for recirculation. One capillary 1202 is provided to be used for inserting a fluid and the other one of the capillaries 1204 is provided to receive the inserted fluid and transfer it (or vice versa). From the one to the other capillary 1204, recirculation (indicated by arrows 1208) of the fluid takes place inside the structure 1206. Thus, expanded parallel cylinders for reagent recirculation are provided.

Figure 13:
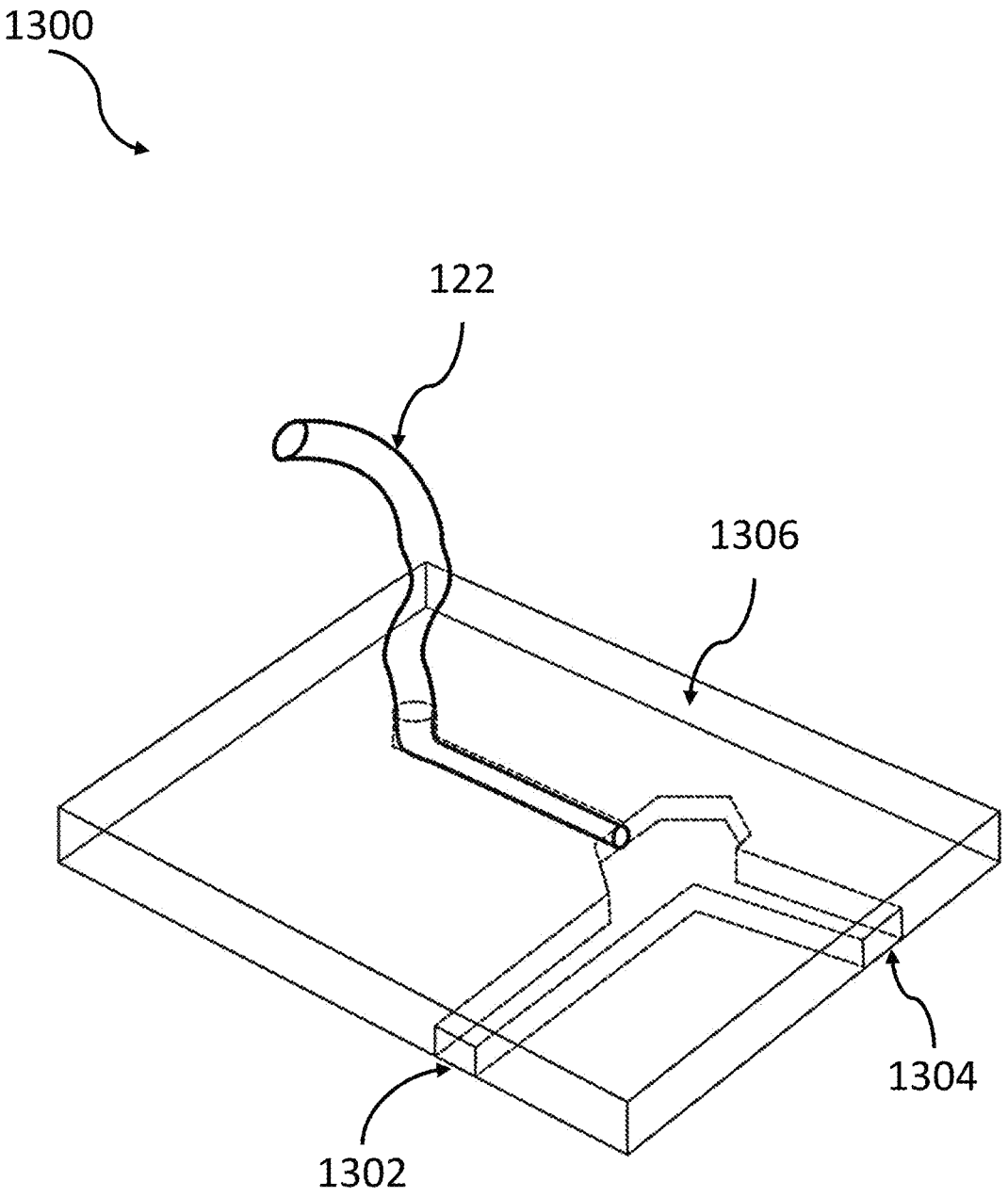
FIG. 13 shows a schematic illustration of an embodiment of a device with two openings for reagents.

FIG. 13 shows a schematic illustration of an embodiment of the device 1300 with two openings 1302 and 1304 for inserting reagents. For example, impermeable coating in gas-permeable microfluidic chips (e.g., PDMS) may be provided. Further, microfluidic chips, like the device 1300, may be connectable with no loss of continuity between channels. Also, capillary 112 is shown entering structure 1306 of the microfluidic chip 1300 from the top.

Figure 14:
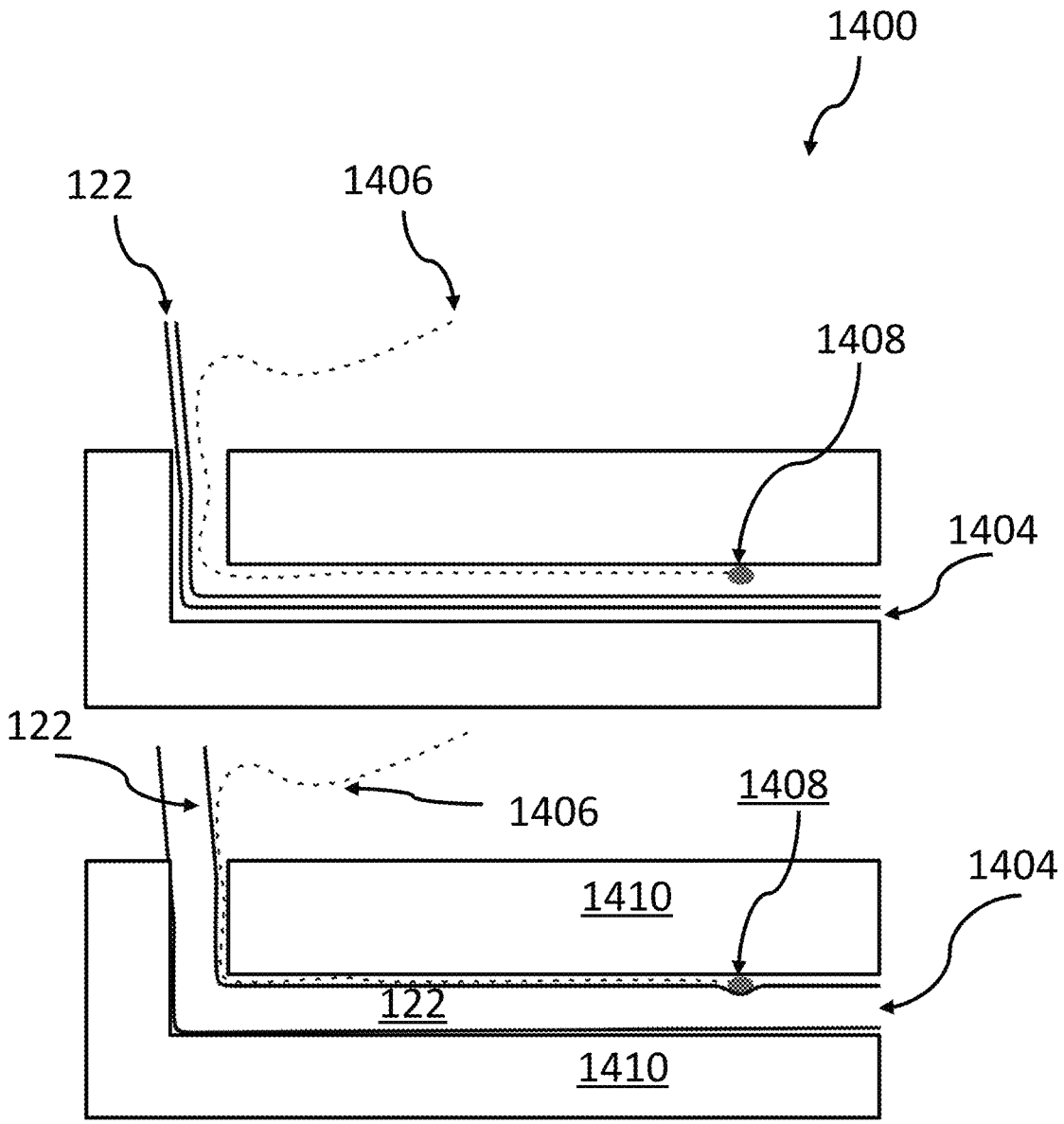
FIG. 14 shows a schematic illustration of an embodiment of a device with a sensing device inside the fluidic channel.

FIG. 14 shows a schematic illustration of an embodiment of the device 1400 with a sensing device 1408 inside the fluidic channel 1404. Therefore, parallel insertion of sensors 1408 or any wiring 1406 is provided before a capillary 122 expansion (compare the upper part of FIG. 14). The lower part of FIG. 14 shows the sensing device 1408 jammed between an outer wall of the capillary 122 and an inner wall of the fluidic channel 1404 of the structure 1410.

Figure 15:
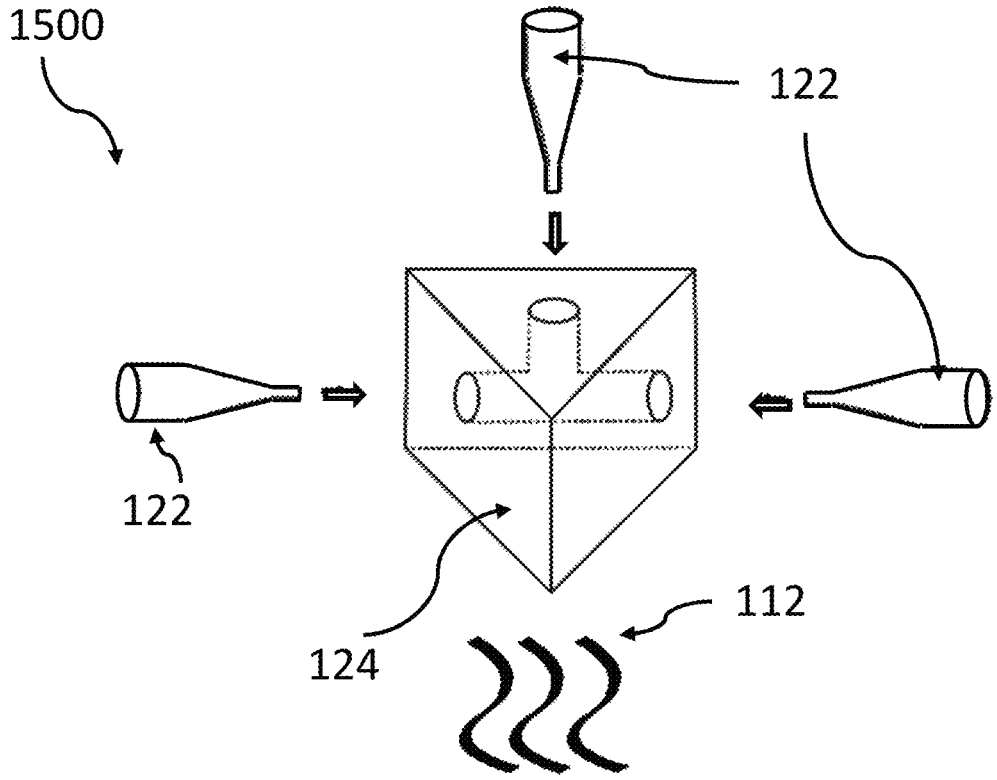
FIG. 15 shows a schematic illustration of an embodiment of a device with a T junction.
Figure 15:
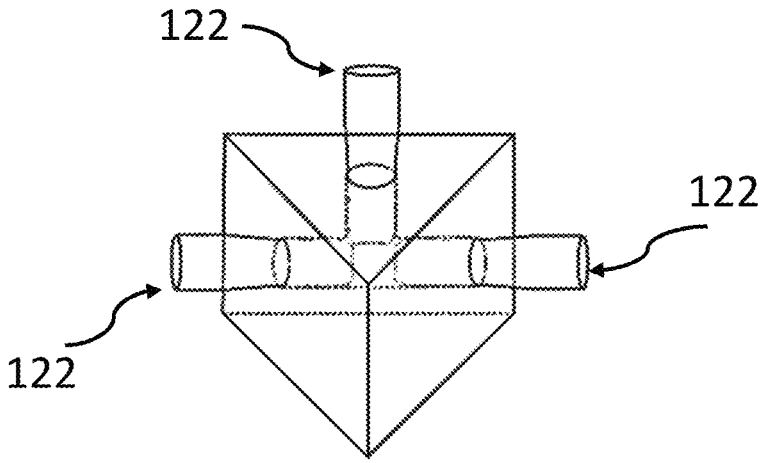

FIG. 15 shows a schematic illustration of an embodiment of the device 1500 with a T-junction. Multiple capillaries 122 (with different materials, see above) are locked inside a surrounding structure 124 (with different materials, see above) to use as connector/switch. The structure 124 comprises channels that connect the different openings. Several capillaries 122 are connected to the structure 124. The surrounding structure 124 may have a different shape as compared to the structure 920 in FIG. 9. For example, the openings of the channels of the structure 124 may be aslant such that a capillary 122 introduced through a respective opening finishes flush such that the opening obliquely surrounds the capillary 122.

Figure 16:
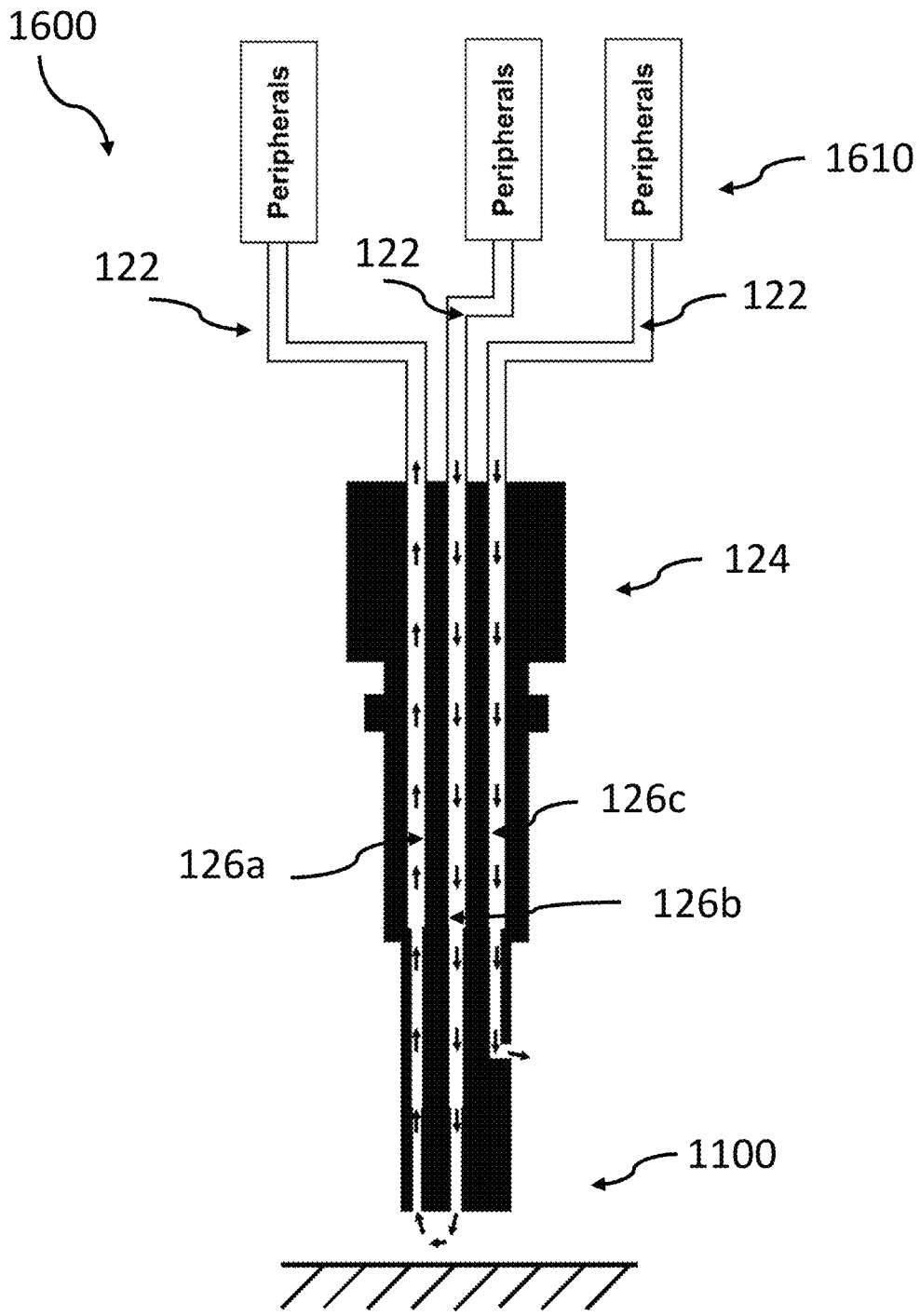
FIG. 16 shows a schematic illustration of an embodiment of a device with multiple operating capillaries.

FIG. 16 shows a schematic illustration of an embodiment of the device 1600 with multiple operating capillaries 122. In an embodiment, the used structure 124 is solid. The solid structure 124 comprises one or more fluidic channels 126*a*, 126*b* and 126*c* (e.g., a microfluidic probe head). The one or more fluidic channels 126*a*, 126*b* and 126*c* are connected to respective peripherals 1610 by one or more capillaries 122. Thus, smooth fluidic paths in multiplexed injection or aspiration channels may be provided. In FIG. 16, the structure

124 is a microfluidic probe head with one aspiration channel 126*a* (arrow going upwards), one injection channel 126*b* and one immersion liquid injection channel 126*c* (arrows going downwards). Thus, a multichannel MFP head 1100 operable on a surface, as shown in the bottom of FIG. 16.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for manufacturing a fluidic device, the method comprising:

providing a capillary;

providing a structure having a fluidic channel and an opening;

reducing an outer diameter of a portion of the capillary to be smaller than the opening of the structure, wherein reducing the outer diameter of the portion of the capillary comprises stretching at least a portion of the capillary;

inserting, at least partly, the portion of the capillary through the opening of the structure into the fluidic channel; and applying heat to the structure to expand the outer diameter of the inserted portion of the capillary to fit the capillary to the structure.

2. The method according to claim 1, wherein the fluidic channel extends from the opening of the structure into the structure.

3. The method according to claim 1, wherein the fluidic channel is a microfluidic channel.

4. The method according to claim 1, wherein the outer diameter of the portion of the capillary is equal to or larger than the opening of the structure before the step of stretching is performed.

5. The method according to claim 1, wherein the structure is another capillary, and wherein an inner diameter of the other capillary is a diameter of the fluidic channel.

6. The method according to claim 1, wherein the structure is a microfluidic device.

7. The method according to claim 6, wherein a material of the microfluidic device includes at least one of the following: silicon; glass; poly methyl methacrylate; PMMA; polydimethylsiloxane; PDMS; aluminum; stainless steel; ceramics; and other polymers.

8. The method according to claim 1, wherein a material of the capillary includes at least one polymer selected from the group consisting of: ethylene tetrafluoroethylene (ETFE), ethylene chlorotrifluoroethylene (ECTFE), fluorinated ethylene propylene (FEP), polyether ether ketone (PEEK), polytetrafluoroethylene (PTFE), perfluoroalkoxy alkane (PFA), polyvinylidene difluoride (PVDF), and tetrahydrocannabivarin (THV).

9. A method for manufacturing a fluidic device, the method comprising:

providing a capillary;

providing a structure having a fluidic channel and an opening, wherein the fluidic channel has an indent for locking the capillary with the structures;

reducing an outer diameter of a portion of the capillary to be smaller than the opening of the structure;

inserting, at least partly, the portion of the capillary through the opening of the structure into the fluidic channel; and applying heat to the structure to expand the outer diameter of the inserted portion of the capillary to fit the capillary to the structure.

10. The method according to claim 1, wherein the outer diameter of the capillary ranges from 50 μm to 5 mm.

11. The method according to claim 1, wherein the opening of the structure has a diameter ranging from 50 μm to 5 mm.

12. The method according to claim 1, wherein the structure comprises another opening, wherein the opening of the structure is a first end of the fluidic channel and the other opening of the structure is a second end of the fluidic channel, and wherein the portion of the capillary is at least partly inserted through the fluidic channel to extend from the first end to the second end.

13. The method according to claim 12, the method further comprising:

providing an adapter for surrounding a section of the capillary which extends over the second end;

cutting, with a cutting tool, the capillary along an edge specified by the adapter; and applying heat to the structure after cutting the capillary.

14. The method according to claim 1, wherein the fluidic channel has a step-like structure, wherein each step reduces a diameter of the fluidic channel such that the diameter of the fluidic channel gets smaller from the opening in a direction into the structure.

15. The method according to claim 14, the method further comprising pulling, after applying heat to the structure, the capillary out of the structure to obtain a capillary having a varying diameter corresponding to the step-like structure off the fluidic channel.

16. The method according to claim 1, the method further comprising inserting a sensing device into the fluidic channel, before applying heat to the structure, to fit the sensing device together with the capillary to the structure.

17. The method according to claim 1, the method further comprising:

providing at least one other capillary;

reducing an outer diameter of a portion of the at least one other capillary; and inserting, at least partly, the portion of the at least one other capillary in parallel to the insertion of the capillary into the structure.

18. A fluidic device comprising:

a capillary;

a structure having a fluidic channel and an opening, a first portion of the capillary is inserted into at least a portion of the structure through the opening, and a second portion of the capillary extends outward from the structure, wherein the fluidic channel has an indent for locking the capillary with the structure, wherein an outer diameter of the second portion of the capillary is greater than a diameter of the opening, and an outer diameter of the first portion of the capillary is the same as the diameter of the opening.

19. The fluidic device according to claim 18, wherein the device is a microfluidic device.

* * * * *